US005170630A

United States Patent [19]

Stern

[11] Patent Number: 5,170,630

[45] Date of Patent: Dec. 15, 1992

[54] PROCESS AND APPARATUS FOR PRODUCING NITROGEN OF ULTRA-HIGH PURITY

[75] Inventor: Sidney S. Stern, Highland Park, N.J.

[73] Assignee: The BOC Group, Inc., Murray Hill, N.J.

[21] Appl. No.: 720,144

[22] Filed: Jun. 24, 1991

[51] Int. Cl.[5] ..... F25J 3/02

[52] U.S. Cl. ..... 62/24; 62/13; 62/29; 62/31; 62/34

[58] Field of Search ..... 62/13, 24, 29, 31, 34

[56] References Cited

U.S. PATENT DOCUMENTS

| | | | |
|---|---|---|---|
| 3,210,947 | 10/1965 | Dubs et al. | 62/13 |
| 3,736,762 | 6/1973 | Toyama et al. | 62/31 X |
| 4,416,677 | 11/1983 | Pahade | 62/24 X |
| 4,526,595 | 7/1985 | McNeil | 62/34 X |
| 4,566,887 | 1/1986 | Openshaw | 62/21 |
| 4,594,085 | 6/1986 | Cheung | 62/31 X |
| 4,617,036 | 10/1986 | Suchdeo et al. | 62/24 X |
| 4,617,037 | 10/1986 | Okada et al. | 62/11 |
| 4,617,040 | 10/1986 | Yoshino | 62/37 |
| 4,777,803 | 10/1988 | Erickson | 62/29 X |
| 4,902,321 | 2/1990 | Cheung | 62/24 |
| 4,966,002 | 10/1990 | Parker et al. | 62/31 |
| 4,968,337 | 11/1990 | Layland et al. | 62/24 |

*Primary Examiner*—Henry A. Bennet
*Assistant Examiner*—Christopher B. Kilner
*Attorney, Agent, or Firm*—David M. Rosenblum; Larry R. Cassett

[57] ABSTRACT

The present invention provides an apparatus and method for producing ultra-high purity nitrogen. In accordance with the method and apparatus, air is rectified to produce a tower overhead comprising high purity nitrogen rich in light elements, such as neon, helium and hydrogen. The tower overhead is then partially condensed within a condenser and separated into liquid and vapor phases within a phase separator. The liquid phase is lean in the light elements and the vapor phase is rich in the light elements. The liquid phase is removed from the bottom of the phase separator and is introduced into the column as reflux. As the reflux drops from tray to tray it is stripped of the light elements. A product stream containing ultra-high purity nitrogen is withdrawn as a liquid from the column after suitable stripping of the reflux. The product stream can be further purified by stripping the product stream within a stripper column.

21 Claims, 5 Drawing Sheets

PROCESS AND APPARATUS FOR PRODUCING NITROGEN OF ULTRA-HIGH PURITY

BACKGROUND OF THE INVENTION

The present invention relates to a process and apparatus for producing high purity nitrogen by the low temperature rectification of air. More particularly, the present invention relates to such a process and apparatus in which light elements, such as helium, hydrogen and neon, are removed from the high purity nitrogen to produce a nitrogen product of ultra-high purity.

Methods and apparatus for producing high purity nitrogen by the low temperature rectification of air are well known in the art. An example of such a method and apparatus is disclosed in U.S. Pat. No. 4,966,002. In this patent, the high purity nitrogen is produced by a single column low temperature rectification process distinguished by its incorporation of a waste recompression cycle. In such a cycle, two partial waste streams of nitrogen are respectively engine expanded and compressed by a compressor coupled to a turboexpander by an energy dissipative brake. The compressed partial waste stream is introduced into the column to enhance nitrogen recovery and the engine expanded partial waste stream is used within the process as a source of refrigeration. Such process and apparatus produces high purity nitrogen at high pressure and at high thermodynamic efficiencies. The product nitrogen is high purity in that it is lean in oxygen. However, the product does contain light elements such as helium, hydrogen and neon, which, due to their volatility, tend to concentrate in the nitrogen product stream in an amount that represents a ten fold increase as compared with their concentration in the entering air. For most industrial applications of nitrogen, such concentrations of light elements are unimportant. However, in the electronics industry, ultra-high purity nitrogen is required in which the product nitrogen is essentially free of the light elements.

U.S. Pat. No. 4,902,321 discloses a process and apparatus for producing ultra-high purity nitrogen that again is illustrated in connection with a single column apparatus. Within the rectification column, a nitrogen rich vapor is produced at the top of the column while an oxygen rich liquid collects at the bottom of the column. A portion of the nitrogen-rich vapor is passed into a condenser where it is condensed by indirect heat exchange with the oxygen rich liquid. The condensed nitrogen is then returned to the column as reflux. A portion of the nitrogen-rich vapor is passed into a shell and tube heat exchanger. Nitrogen-rich vapor rises in the heat exchanger and is progressively partially condensed to produce a nitrogen rich liquid which also collects at the bottom of the heat exchanger. A stream of the nitrogen-rich liquid is expanded to a lower pressure and is then introduced into the shell side of the heat exchanger. The expansion produces a pressure difference between the entering nitrogen rich vapor and the expanded nitrogen rich liquid to in turn produce heat exchange between the vapor and the liquid. The result of this heat exchange is condensation of the nitrogen rich vapor and vaporization of the expanded nitrogen rich liquid which is removed from the heat exchanger as the ultra-high purity nitrogen product.

As can be appreciated, the addition of a shell and tube heat exchanger adds to plant fabrication costs. As will discussed, the present invention provides a process and apparatus to produce an ultra-high purity nitrogen product that in its most basic form, only minimally increases plant fabrication costs. In fact, the present invention can be incorporated into the apparatus used in effectuating the process disclosed in U.S. Pat. No. 4,966,002 with only slight modification to such apparatus.

SUMMARY OF THE INVENTION

The present invention provides a process of producing ultra-high purity nitrogen. In accordance with this process, air is rectified within a rectification column by a low temperature rectification process. The low temperature rectification process process produces a tower overhead containing a high purity nitrogen vapor rich in light elements. A stream of the tower overhead is partially condensed so that the stream of the tower overhead contains a liquid phase lean in the light elements and a gaseous phase rich in the light elements. Thereafter, the gaseous phase is separated from the stream of the tower overhead and the stream of the tower overhead is returned to the rectification column as reflux. Within the rectification column, the light elements are stripped from the reflux to produce the ultra-high purity nitrogen as liquid. A product stream is extracted from the rectification column composed of ultra-high purity nitrogen liquid. Depending upon the rectification process, the product stream can be either directly supplied to the customer, further purified before being supplied to the customer and/or used within the rectification process, for instance, to recover its cooling potential and then supplied to the customer.

The product stream can be further purified to form a further purified product stream by stripping further light elements from the product stream by a stripper gas. Specifically, the product stream can be introduced into the top of a stripper column, and the stripper gas into the stripper column below the the product stream. This produces further purified ultra-high purity nitrogen as liquid at the bottom of the stripper column and a stripper tower overhead. The further purified product stream is then produced by extracting the further purified ultra-high purity nitrogen liquid from the bottom of the stripper column.

Nitrogen production rates can be increased by extracting a stripper tower overhead stream from the top of the stripper column, recompressing the stripper tower overhead stream to rectification column pressure, and introducing the compressed stripper tower overhead stream into the rectification column. Alternatively, in order to avoid the expense of recompression, the stripper tower overhead stream can be extracted from the stripper column and partially condensed to produce liquid and gaseous phases within the stripper tower overhead stream. The liquid and gaseous phases of the stripper tower overhead stream are lean and rich in the light elements, respectively. The gaseous phase is separated from the stripper tower overhead stream and then the stripper tower overhead stream is introduced into the stripper column for stripping therewithin by the stripper gas. Additionally, a process liquid such as crude oxygen enriched liquid produced at the bottom of the rectification column, can be extracted from the rectification column as a process liquid stream. The stripper tower overhead stream can be partially condensed against partially vaporizing the process liquid stream. The refrigeration potential can then be recovered from the partially condensed liquid product stream and then introduced into the low temperature rectification process to increase production of the product stream. The increased production of the product stream is accompanied by further increased production of the further purified product stream.

In another aspect, the present invention provides an apparatus for producing an ultra high purity nitrogen product. In accordance with this aspect of the invention, low temperature rectification means are provided having a rectification column for rectifying air within the rectification column. Nitrogen and light elements concentrate as tower overhead in the form of a high purity nitrogen as vapor rich in the light elements. Condensing means are connected to the top of the rectification column for partially condensing a stream of the tower overhead so that the stream contains a gaseous phase rich in the light elements and a liquid phase lean in the light elements. Phase separation means receive the stream from the condensing means for separating the gaseous phase from the stream of the tower overhead. The phase separation means are connected to the top of the rectification column so that the liquid stream of the tower overhead returns to the top of the rectification column as reflux. The column is sized such that the reflux is stripped of the light elements to form the ultra-high purity nitrogen as liquid below the top of the column. Lastly, delivery means are provided for extracting the ultra-high purity nitrogen from the column as a liquid and for delivery the ultra-high purity nitrogen from the apparatus as liquid or vapor.

The delivery means may also be provided with means for further purifying the product stream to form a further purified product stream and for delivering the further purified product stream from the apparatus. Such means can comprise means for producing a stripper gas leaner in the light elements than the ultra-high purity nitrogen liquid and a stripper column connected to the stripper gas production means so that the stripper gas rises in the stripper column. The stripper column is connected to the rectification column so that the product stream extracted therefrom falls in the stripper column and is stripped by the stripper gas to produce further purified ultra-high purity nitrogen as liquid, at the bottom of the stripper column. Means are provided for extracting the further purified ultra-high purity nitrogen from the bottom of the stripper column and for forming the further purified product stream from the extracted ultra-high purity nitrogen liquid.

In order to increase production rate of the further purified ultra-high purity nitrogen, a recycle compressor can be connected between the top of the stripper column and a suitable point of the rectification column for compressing a stripper tower overhead stream to column pressure and for introducing the compressed stripper tower overhead stream into the rectification column. Alternatively, means can be connected to the top of the stripper column for partially condensing a stripper tower overhead stream, and thereby producing within the stripper tower overhead stream a rich gaseous phase and a lean liquid phase, rich and lean in light elements, respectively. Separation means are provided for separating the rich gaseous phase from the lean liquid phase. The separation means are connected to the stripper column so that the lean liquid phase falls within the column and is also stripped by the stripper gas.

In accordance with the process and apparatus of the present invention, a high purity nitrogen process or plant design can readily be modified to produce ultra-high purity nitrogen by modifying the condenser and column and by adding a phase separation tank and associated piping. The phase separation tank acts to separate a gaseous phase of a partially condensed stream to purify the stream by removal of light elements from the stream. When the stream is returned to the column as reflux, the top of the column acts to further strip light elements from the reflux to produce the ultra-high purity nitrogen. The process and apparatus of the present invention by using an inexpensive phase separation tank and the column itself as purifiers is more adaptable, at lower expense, to upgrade the capability of high purity nitrogen production schemes to ultra-high purity production.

BRIEF DESCRIPTION OF THE DRAWINGS

While the specification concludes with claims distinctly pointing out the subject matter that Applicant regards as his invention, it is believed that the invention will be better understood when taken in conjunction with the accompanying drawings, in which:

Figure 4:
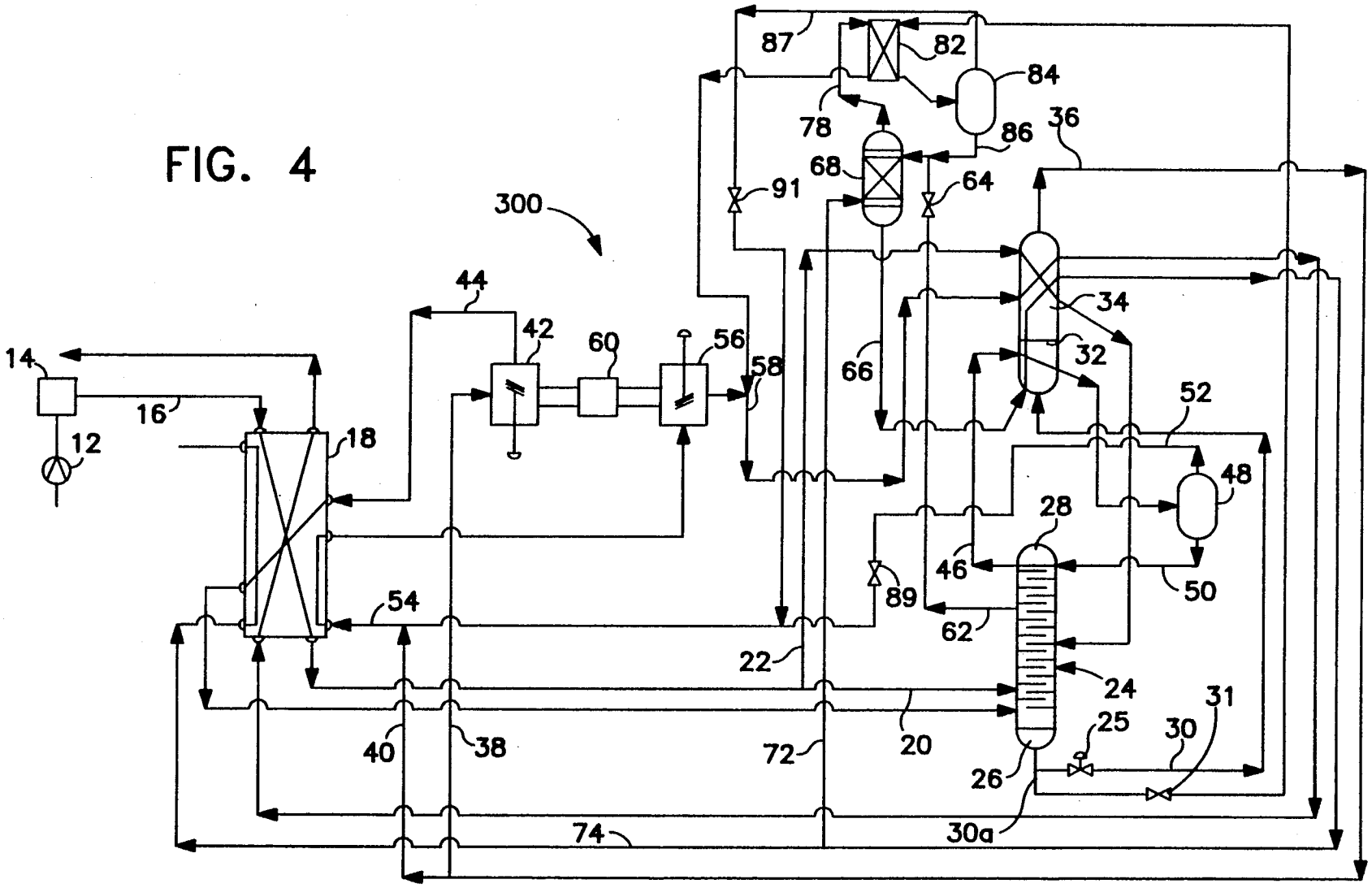
FIG. 4 is a schematic view of a still further embodiment of an air separation plant in accordance with the present invention.

All of the embodiments illustrated above, represent the process and apparatus of the present invention applied to an air separation plant illustrated in FIG. 4 of U.S. Pat. No. 4,966,002, the specification and drawings of which are hereby incorporated by reference. For the sake of simplicity of explanation, the same reference numerals will be used in the accompanying drawings for identical components and streams of process fluid passing between the components. Additionally, arrowheads are used to show flow direction of the process fluid between the components.

DETAILED DESCRIPTION

Figure 1:
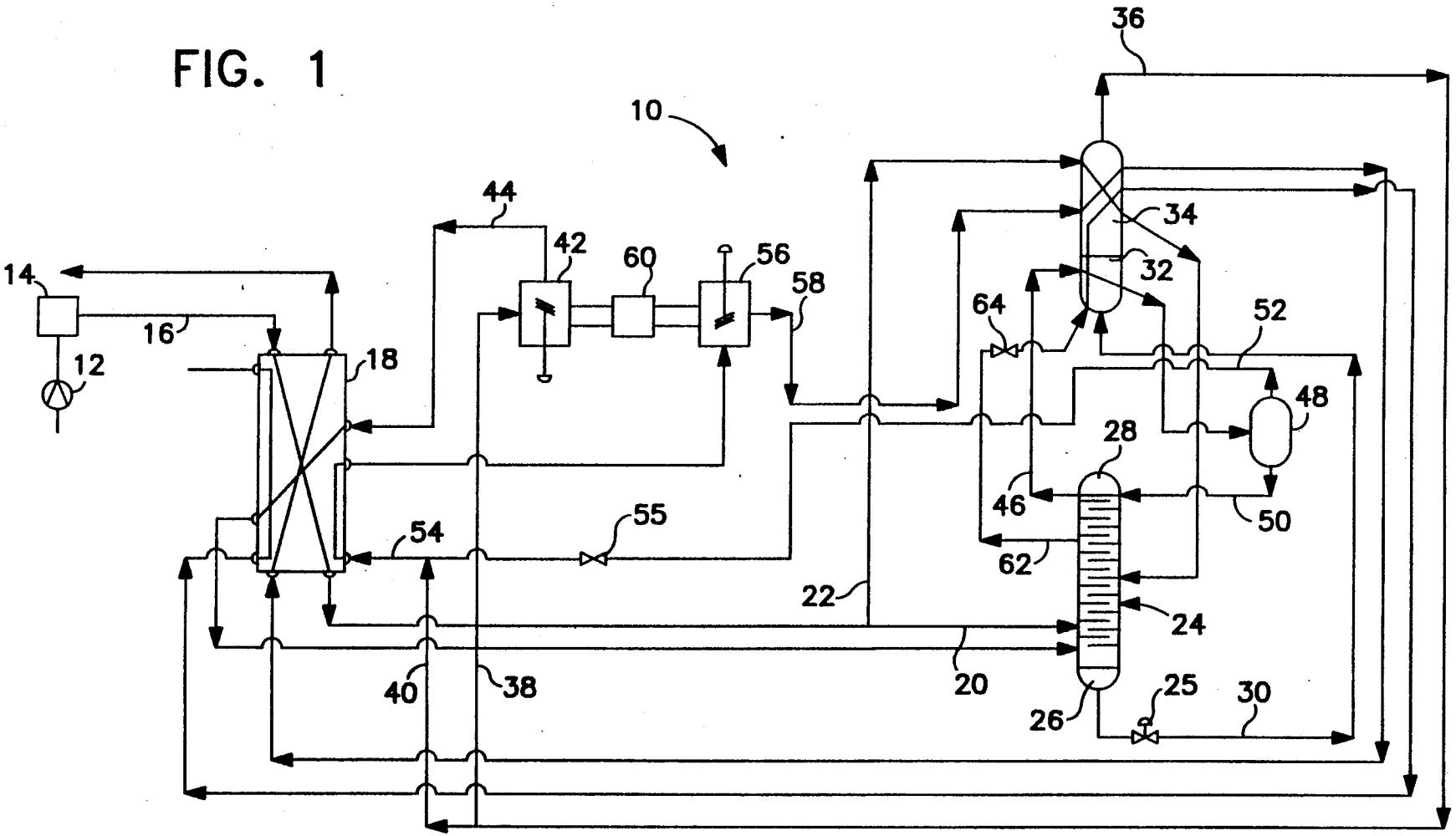
FIG. 1 is a schematic view of an air separation plant in accordance with the subject invention.

With reference to FIG. 1, an air separation plant 10 in accordance with the present invention as illustrated. In air separation plant 10, air is compressed by a compressor 12 and is then purified in a pre-purification unit 14. Pre-purification unit 14 is a PSA unit having beds of activated alumina and molecular sieve material to adsorb carbon dioxide, water, and hydrocarbon. An air stream 16 of the now compressed and purified air is then cooled in a main heat exchanger 18 of plate-fin design. Air stream 16 is then split into two portions 20 and 22. Portion 20 of air stream 16 is introduced into a rectification column 24 having approximately 79 trays. The air is rectified within rectification column 24 to produce a column bottom comprised of an oxygen rich liquid 26 and a tower overhead 28. In rectification column 24 nitrogen as a high purity liquid is produced at tray 75, spaced 4 trays from the top of column 24. Hence, tower overhead 28 consists of high purity nitrogen vapor rich in the light elements which tend to concentrate in the tower overhead due to the volatility of the lights elements.

A waste stream 30 of oxygen rich liquid is extracted from the bottom of rectification column 24. A back pressure valve 25 is used to maintain column pressure. After passage through back pressure valve 25, waste stream 30 is vaporized and warmed in a condenser 32 and air liquefier 34 of plate-fin design to produce a warm waste stream stream 36. Warm waste stream 36 is split into two portions 38 and 40. Portion 38 is compressed in a compressor 42 to produce a compressed waste stream 44. Compressed waste stream 44 is cooled in main heat exchanger 18 and is then passed into the bottom of rectification column 24 to enhance the nitrogen recovery rate.

A stream 46 of tower overhead 28 is extracted from the top of rectification column 24. In accordance with the present invention, stream 46 is partially condensed in condenser 32 and is then introduced into a phase separator 48. A liquid phase lean in the light elements collects in the bottom of phase separator 48 and a gaseous phase rich in the volatile light elements collects in the top of phase separator 48. Phase separator 48 is connected to the top of rectification column 24 to reintroduce the liquid phase of partially condensed stream 46, as reflux stream 50, back to rectification column 24. Hence, the partial condensation followed by the phase separation of stream 46 acts to partially purify stream 46 by separating the vapor phase from the stream after partial condensation thereof. The vapor fraction is removed as a stream 52 and is subsequently combined with portion 40 of waste stream 36 to form a combined stream 54. A back pressure controller 55 is used to reduce the pressure of stream 52 to that of portion 40 of waste stream 36. The combined stream 54 is partially heated in main heat exchanger 18, engine expanded in a turboexpander 56 to produce refrigeration in the form of an expanded waste stream 58. It is to be noted that compressor 42 is coupled to turboexpander 56 by a common shaft having an oil brake 60 to dissipate some of the work from the expansion process. Expanded waste stream 58 partially warms in air liquefier 34 and fully warms to ambient temperature in main heat exchanger 18 before leaving the process. In so warming, stream 58 cools incoming air stream 16.

As mentioned previously, rectification column 24 has approximately 79 trays, roughly 4 more trays than found in the rectification column of U.S. Pat. No. 4,966,002. The reason for this will become apparent. After reflux stream 50 is reintroduced into the top of rectification column 24, it drops from tray to tray while being stripped of the light elements. Thus, a product stream 62 drawn roughly 4 trays below the top of rectification column 24 as a liquid is still leaner with respect to the light elements than stream 50 and in fact comprises nitrogen of ultra-high purity. A back pressure valve 64 is used to maintain column pressure in spite of the withdrawal of product stream 62. After passage through back pressure valve 64, product stream 62 is then vaporized and warmed by passing through condenser 32 to partially condense stream 46 and then air liquefier 34 to also help liquefy portion 22 of cooled air stream 16. This partially warms product stream 62 which is introduced into main heat exchanger 18 to fully warm product stream 62 to ambient temperature.

Figure 2:
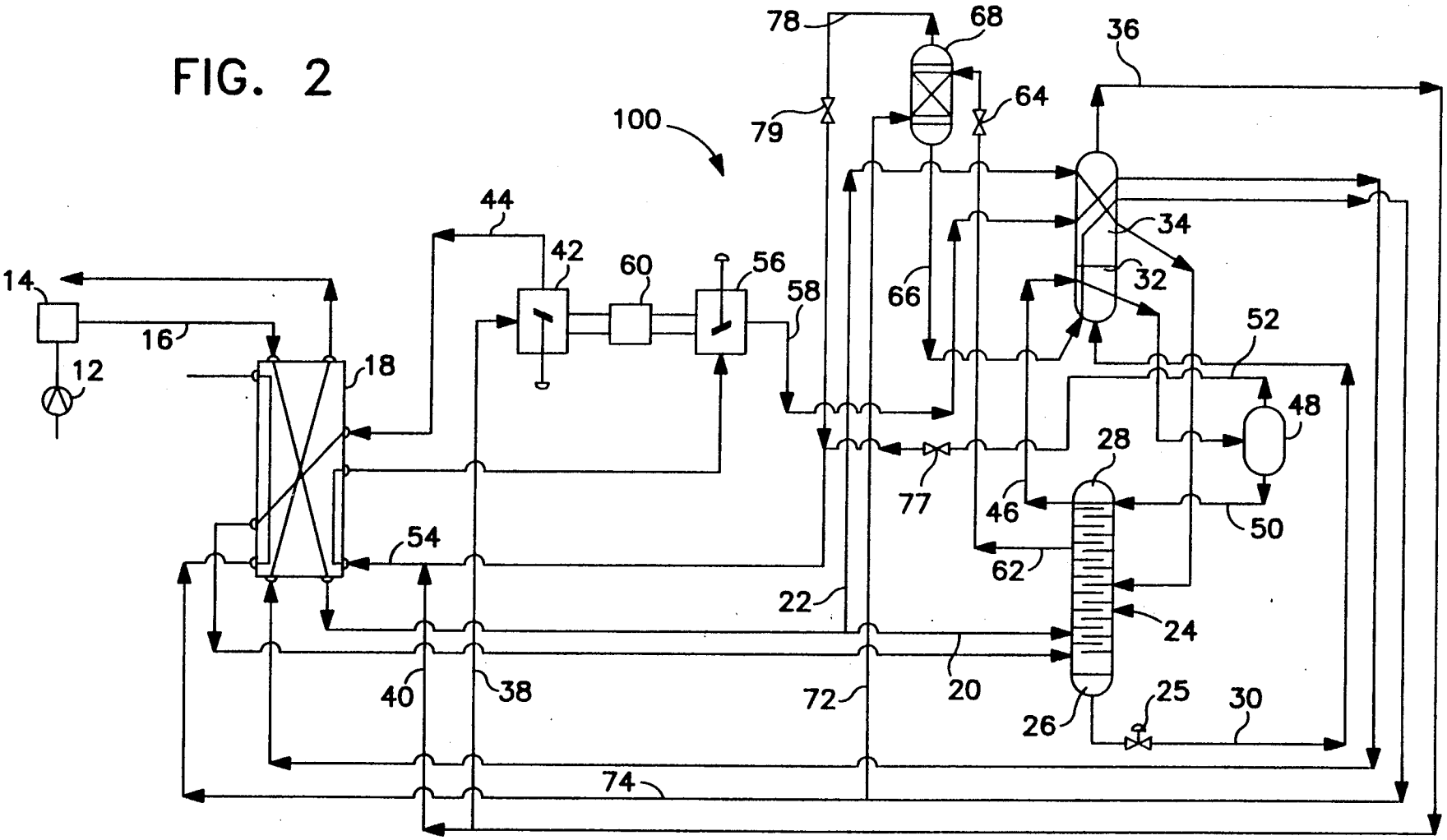
FIG. 2 is a schematic view of an alternative embodiment of an air separation plant in accordance with the present invention.

With reference to FIG. 2, an air separation 100 is illustrated. Air separation plant 100 is capable of producing a further purified product stream 66 of higher purity than product stream 62 produced by air separation plant 10. In air separation plant 100, product stream 62 is again withdrawn about 4 trays from the top of rectification column 24. Product stream 62 is then introduced into a stripper column 68, a packed column of approximately 4 stages, where product stream 62 is further stripped by a stripper gas having a higher purity than product stream 62. The stripper gas is introduced into stripper column 68 below the point of entry of product stream 62 and is used in forming further purified product stream 66 which collects as a liquid at the bottom of stripper column 68.

Further purified product stream 66 is extracted from the bottom of stripper column 68 and is then vaporized in condenser 32 and air liquefier 34. Further purified product stream 66, is then split into two partial streams 72 and 74. Partial stream 72 of further purified product stream 66 forms the stripper gas and as such, is introduced into the bottom of stripper column 68. The other partial stream 74 of further purified product stream is warmed to ambient temperature in main heat exchanger 18 for delivery to the customer. The stripper overhead of stripper 68 is extracted at the stream 78, which is combined with streams 52 and portion 40 of waste stream 36 to produce combined stream 54 which is partially warmed and then expanded in turbo expander 56 to produce expanded waste stream 58. Back pressure controllers, 77 and 79 are used to reduce the pressure of streams 52 and 78 to that of portion 40 of waste stream 36. The advantage of this last aspect of plant operation over that of air separation plant 10 is that the the amount of expansion is increased by the increase in flow into turboexpander 56 to allow more nitrogen to be recompressed in compressor 42 for addition to rectification column 24. As a result, the process and apparatus involved in plant 100 allows for the production of ultra-high purity nitrogen product having a greater purity than that produced by the process and apparatus of air separation plant 10 at an equivalent rate of production.

Figure 3:
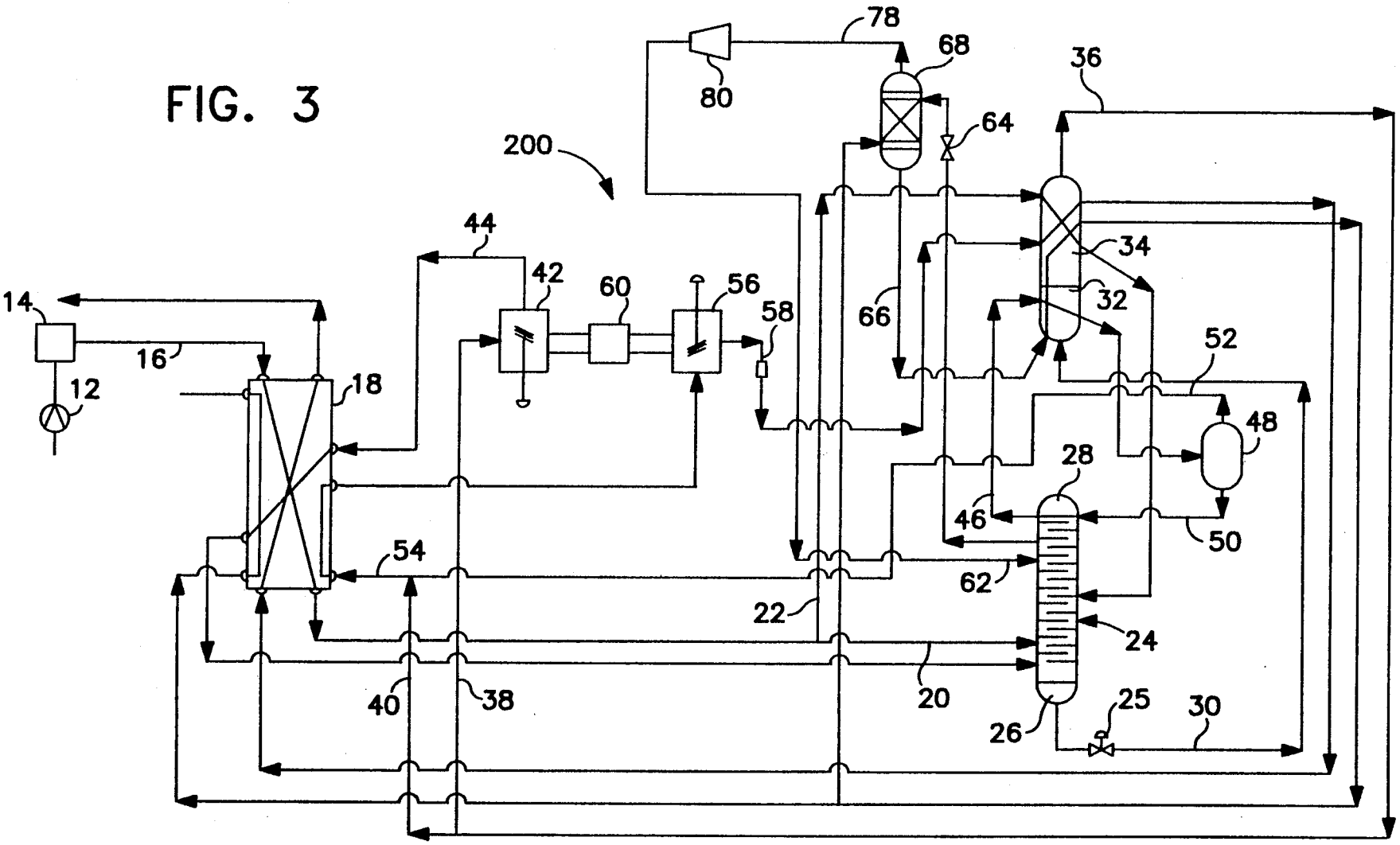
FIG. 3 is a schematic view of a further alternative embodiment of an air separation plant in accordance with the present invention.

FIG. 3 illustrates an air separation plant 200 that is similar in operation to plant 100, illustrated in FIG. 2. The sole difference between plant 200 and 100, is that stream 78, composed of a stripper overhead, is compressed in a recompressor 80 to column pressure and is introduced back into the column, at an appropriate concentration level. The additional nitrogen introduced into rectification column 24 enhances the recovery rate of ultra-high purity nitrogen over the plant and process illustrated in FIG. 2.

With reference to FIG. 4, an air separation plant 300 is illustrated. Air separation plant 300 is capable of producing more ultra-high purity nitrogen than air separation plant 100, illustrated in FIG. 2, without the recompression of the stripper overhead and thus, the added operational expenses of air separation plant 200, illustrated in FIG. 3.

In air separation plant 300, product stream 62 is extracted from rectification column 24 for further purification before delivery. To this end, product stream 62 is introduced into the top of stripper column 68 for further stripping against a stripper gas made up of partial stream 72 of further purified product stream 66. Stream 78 composed of stripper tower overhead is partially condensed in a stripper recondenser 82 and is then introduced into a phase separator 84. In phase separator 84, liquid and vapor phases form, lean and rich in light elements, respectively. A stream 86 from the bottom of phase separator 84 is introduced into the top of stripper column 68 along with product stream 62 to enhance the recovery rate of ultra-high purity nitrogen.

A side waste stream 30*a* is extracted from waste stream 30 and then fully vaporized in stripper recondenser 82. A back pressure valve 31 is provided to maintain column pressure of rectification column 24. Side waste stream 30*a* is then introduced into the outlet stream of turboexpander 56 to recover the refrigeration contained therein. The vapor phase is extracted from the top of Phase separator 84 as a stream 87 and is then combined with stream 52 of phase separator 48 for expansion with portion 40 of waste stream 36. This produces additional refrigeration to also enhance liquid nitrogen production. Back pressure controllers 89 and 91 are used to reduce the pressures of stream 52 and 87 to that of portion 46 of waste stream 36.

Figure 5:
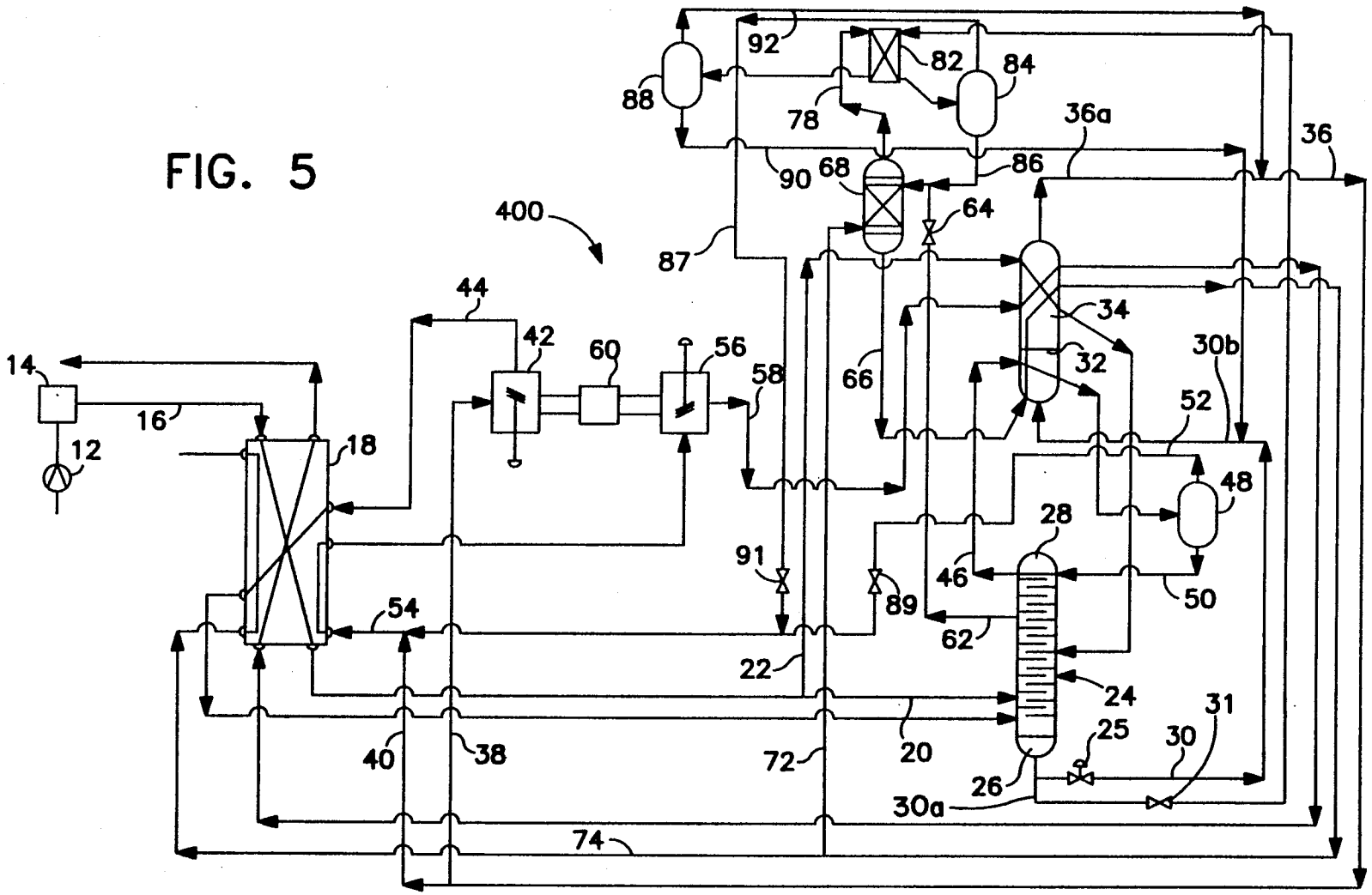
FIG. 5 is yet another embodiment of an air separation plant in accordance with the present invention.

FIG. 5 illustrates an air separation plant 400, which contains all of the components of air separation plant 300 with the addition of a phase separation tank 88. The objective of air separation plant 400 is to increase the degree of recompression and expansion over that involved in air separation plant 300 in order to efficiently increase the recovery rate of ultra-high purity nitrogen. Unlike air separation plant 300, side waste stream 30*a* is only partially vaporized in stripper recondenser 82. The partial vaporization of side waste stream 30*a* results in a high enough pressure to recover the refrigeration potential. Such recovery is effected by passing partially condensed waste side stream 30*a* into phase separation tank 88 for separation into liquid and vapor phases. A stream 90 composed of the liquid phase is extracted from the bottom of phase separator 88. Stream 90 is then added to waste stream 30 to add to the flow to be expanded and increase the amount to be recompressed. In addition, since stream 90 is added to waste stream 30 before its introduction into condenser and air liquefier, more tower overhead can be partially condensed, purified, stripped and recovered. The resultant waste stream 30*b* is introduced into condenser 32 and air liquefier 34 to produce a warm waste stream 36*a*. A stream 92 composed of the vapor phase is extracted from the top of phase separator 88. Stream 92 is added to warm waste stream 36*a* after passage through condenser and air liquefier to form warm waste stream 36 which contains added flow to be expanded and recompressed. The refrigeration potential is recovered by adding streams composed of the liquid phase after vaporization and warming and the vapor phase into the combined stream 54 to be expanded into turboexpander 56.

It is to be noted that features of Applicant's invention have application to other air separation plants and processes in addition to those incorporating a waste recompression cycle. For instance, in a manner akin to that shown in any of the embodiments discussed hereinabove, a high pressure column of a two column low temperature rectification process could be used to produce high purity nitrogen as liquid at a level thereof spaced below the top of such column. High purity nitrogen, rich in light elements could be partially condensed, sent to a phase separator for removal of a vapor phase rich in light elements, and then reintroduced to the column for stripping and thus, purification to produce ultra-high purity nitrogen. Additionally, in a manner akin to that shown in the embodiments of FIGS. 2–5, the product of such high pressure column could be further refined by its introduction into a stripper column to be stripped by a stripper gas. In a process similar to that shown in FIG. 3, the stripper overhead could then be recompressed and reintroduced into the column to enhance nitrogen production rates. Additionally, by methodology similar to that shown in FIGS. 4 and 5, production rates could be enhanced by the partial condensation of the stripper overhead followed by phase separation and introduction of a stream composed of the liquid phase into the top of the stripper column.

EXAMPLE 1

In this example, ultra-high purity nitrogen is recovered though the use of the process and apparatus illustrated in FIG. 1. The nitrogen product obtained from this process is contained within a product stream 62 flowing at a rate of about 1115.0 $Nm^3$/hr. and containing approximately 0.5 ppb oxygen, 0.57 ppm neon, and 5.0 ppb helium. It is to be noted that the process and apparatus of FIGS. 1–5 also separate hydrogen from high purity nitrogen. Such separation is carried out in the pre-purification unit 14 as well as rectification column 24. Practically, the concentration of hydrogen in the examples will lie between helium and neon. Additionally, in this and succeeding examples, pressures and given in absolute.

Air stream 16 upon entry to main heat exchanger 18 has a temperature of about 278.7° K., a pressure of 11.7 kg/$cm^2$, and a flow rate of approximately 2462.0 $Nm^3$/hr. Upon leaving mean heat exchanger 18, air stream 16 has a temperature of approximately 109.9° K. and a pressure of about 11.00 kg/$cm^2$. After division of air stream 16, portion 20 of stream 16 has a flow rate of approximately 2370.0 $Nm^3$/hr and portion 22 has a flow rate of about 92.0 $Nm^3$/hr. After liquefaction, portion 22 has a temperature of about 107.4° K., and a pressure of about 10.98 kg/$cm^2$.

Waste stream 30 has a flow rate of approximately 1347.0 $Nm^3$/hr., a temperature and pressure of approximately that of the column, namely 109.9° K., and 11.01 kg/$cm^2$, respectively. Back pressure valve 25 produces temperature and pressure drops within waste stream 30 to about 101.0° K. and about 6.0 kg/$cm^2$. After warming, the resultant warm waste stream 36 has a temperature of approximately 106.6° K., and a pressure of approximately 5.87 kg/$cm^2$. Portion 38 of warm waste stream 36 has a flow rate of approximately 870.0 $Nm^3$/hr. and portion 40 has a flow rate of approximately 321.0 $Nm^3$/hr. After passage through compressor 42, the resultant compressed waste stream 44 has a temperature of about 42.9° K. and a pressure of approximately 11.08 kg/$cm^2$ and after passage through main heat exchanger 18, compressed waste stream 44 has a pressure of approximately 11.01 kg/$cm^2$ and a temperature of approximately 112.7° K.

Stream 52, representing the vapor fraction removed from stream 46 of tower overhead, has a temperature of about 104.5° K., a pressure of about 10.7 kg/$cm^2$, and a flow rate of approximately 26.0 $Nm^3$/hr. When combined with portion 40 of waste stream 36, combined stream 54 has a flow rate of approximately 1347.0 $Nm^3$/hr. After combined stream 54 passes through main heat exchanger 18, it has a temperature of about 142.0° K., a pressure of about 5.77 kg/$cm^2$. The resultant expanded waste stream 58 has a temperature of about 106° K. and a pressure of about 1.53 kg/$cm^2$. Expanded waste stream 58 leaves air liquefier 34 at a temperature of about 106.6° K. and subsequently leaves main heat exchanger 18 with a temperature of about 274.0° K. and a pressure of about 1.50 kg/$cm^2$. Product stream 62 leaves air liquefier 34 as a vapor at a temperature of about 104.6° K., and a pressure of about 9.67 kg/cm$^2$. Back pressure valve 64 produces a pressure and temperature drop within product stream 62 to about 9.79 kg/cm$^2$ and about 103.2° K. After passing though main heat exchanger 18, product stream 62 has a temperature of about 274.0° K., and a pressure of about 9.55 kg/cm$^2$.

EXAMPLE 2

In this example, ultra-high purity nitrogen is recovered though use of the process and apparatus shown in FIG. 2. The nitrogen product obtained from this process is contained within partial stream 74 of product stream 66 flowing at a rate of about 1115.0 Nm$^3$/hr. and containing approximately 0.5 ppb oxygen, 31 ppb neon, and about 0.03 ppb helium. In this example product stream 74 has a lower concentration of light elements than product stream 66 of the preceding example through the use of stripper column 68.

Air stream 16 upon entry to main heat exchanger 18 has a temperature of about 278.7° K., a pressure of 11.17 kg/cm$^2$ and a flow rate of approximately 2661.0 Nm$^3$/hr. Upon leaving mean heat exchanger 18, air stream 16 has a temperature of approximately 109.9° K. and a pressure of about 11.00 kg/cm$^2$. After division of air stream 16, portion 20 of air stream 16 has a flow rate of approximately 2553.0 Nm$^3$/hr and portion 22 has a flow rate of about 108.0 Nm$^3$/hr. After liquefaction, portion 22 has a temperature of about 107.4° K., and a pressure of about 10.98 kg/cm$^2$.

Waste stream 30 has a flow rate of approximately 2405.0 Nm$^3$/hr., a temperature of about 109.9° K., and a pressure of about 11.01 kg/cm$^2$. Back pressure valve 25 reduces the temperature and pressure of waste stream 30 to 100.9° K. and about 6.00 kg/cm$^2$. After vaporization and warming, the resultant warm waste stream 36 has a temperature of approximately 106.6° K. and a pressure of approximately 5.87 kg/cm$^2$. After division of warm waste stream 36, the resulting portions 38 and 40 flow at about 987.0 Nm$^3$/hr and 1418.0 Nm$^3$/hr, respectively. Stream 38 is compressed in compressor 42 to form compressed waste stream 44 having a temperature of about 142.9° K. and a pressure of approximately 11.08 kg/cm$^2$. After passage through main heat exchanger 18, compressed waste stream 44 has a pressure of approximately 11.02 kg/cm$^2$ and a temperature of approximately 112.7° K.

Stream 52, representing the vapor fraction removed from stream 46 of tower overhead, has a temperature of about 104.6° K., a pressure of about 10.71 kg/cm$^2$, and a flow rate of approximately 26.0 Nm$^3$/hr. Stripper overhead stream 78 has a flow rate of about 102.2 Nm$^3$/hr, a temperature of 102.8° K., and a pressure of about 9.53 kg/cm$^2$. When stripper overhead stream 78 is added to stream 52 and portion 40 of heated waste stream 36, combined stream 54 has a flow rate of about 1546.0 Nm$^3$/hr, a temperature of about 105.7° K., and a pressure of about 5.87 kg/cm$^2$. After combined stream 54 passes through main heat exchanger 18 its temperature increases to about 141.0° K. The expanded waste stream 58 has a temperature of about 105.0° K. and a pressure of about 1.63 kg/cm$^2$. Expanded waste stream 58 leaves air liquefier 34 with a temperature of about 106.6° K. and a pressure of about 1.55 kg/cm$^2$ and subsequently leaves main heat exchanger 18 with a temperature of about 274.0° K. and a pressure of about 1.30 kg/cm$^2$.

Product stream 62 is introduced into stripper column 68 at a flow rate of about 1217.0 Nm$^3$/hr, a temperature of about 103.0° K., and a pressure of about 9.67 kg/cm$^2$. Further purified product stream 66 is extracted from the bottom of stripper column 68 at a flow rate of about 1183.0 Nm$^3$/hr, a temperature of about 103.0° K., and a pressure of about 9.67 kg/cm$^2$. Further purified product stream 66 is vaporized and heated and leaves air liquefier 34 at a temperature of about 106.6° K., and a pressure of about 9.67 kg/cm$^2$. Partial stream 72 has a flow rate of about 68.0 Nm$^3$/hr and is introduced into stripper column 68 as stripper gas. Partial stream 74 is warmed in main heat exchanger 18 to a temperature of about 274.0° K. and a pressure of about 9.55 kg/cm$^2$ and delivered as product.

EXAMPLE 3

A nitrogen product of ultra-high purity is recovered having essentially the same purity as the product produced in Example 2. The recovery rate of the nitrogen product is enhanced with respect to that of Example 2 by compressing stripper overhead stream 78 and introducing it into column 24 in the manner and the apparatus shown in FIG. 3. In this regard, partial stream 74 which contains the ultra-high purity nitrogen product flows at about 1115.0 Nm$^3$/hr as in the previous example. However, entering air stream 16 in this example flows at about 2467.0 Nm$^3$/hr as compared to 2661.0 Nm$^3$/hr in Example 2. In the main, the pressures and temperatures of the streams is the same as that in Example 2, except as indicated otherwise in the discussion set forth below.

After division of air stream 16, portion 20 of air stream 16 has a flow rate of approximately 2373.0 Nm$^3$/hr and portion 22 has a flow rate of about 94.0 Nm$^3$/hr.

Waste stream 30 has a flow rate of approximately 2199.0 Nm$^3$/hr., and after division, the resulting portions 38 and 40 flow at about 873.0 Nm$^3$/hr and about 1326.0 Nm$^3$/hr, respectively.

Stream 52, representing the vapor fraction removed from stream 46 of tower overhead, has a flow rate of approximately 26.0 Nm$^3$/hr and is added to portion 40 of heated waste stream 36 to form combined stream 54 having a flow rate of about 1352.0 Nm$^3$/hr. After combined stream 54 passes through main heat exchanger 18 its temperature increases to about 142.3° K. and after passage through expander 56, the resultant expanded waste stream 58 has a temperature of about 105.9° K.

Product stream 62 is introduced into stripper column 68 at a flow rate of about 1212.0 Nm$^3$/hr and further purified product stream 66 is extracted from the bottom of stripper column 68 at a flow rate of about 1177.0 Nm$^3$/hr. After division of further purified product stream, partial stream 72 has a flow rate of about 62.0 Nm$^3$/hr for introduction into stripper column 68 as stripper gas. Stripper tower overhead stream 78 has a flow rate of about 97.0 Nm$^3$/hr. After passage through recompressor 80, stripper tower overhead stream 78 has a temperature of about 108.5° K. and a pressure of about 10.73 kg/cm$^2$ for introduction into rectification column 24.

EXAMPLE 4

An ultra-high purity nitrogen product is recovered by the use of the the process and apparatus illustrated in FIG. 4. The purity of the product is essentially that of Example 2 in that it contains approximately 0.5 ppb oxygen, 38.0 ppb neon and 0.03 ppb helium. The recovery rate is greater than that of Example 2 but without the added power consumption arising in Example 3 by recompression of the stripper tower overhead. In this regard, the further purified product flows at about 1115.0 $Nm^3/hr$ and is produced from air stream 16 entering main heat exchanger 18 at a flow rate of about 2539.0 $Nm^3/hr$.

Air stream 16 enters main heat exchanger 18 with a temperature of 278.7° K. and a pressure of 11.17 $kg/cm^2$. Within main heat exchanger 18, the Pressure and temperature of air stream 16 drops to about 11.00 $kg/cm^2$ and about 109.9° K., respectively. After division of air stream 16, portion 20 has a flow rate of approximately 2443.0 $Nm^3/hr$ and portion 22 has a flow rate of about 96.0 $Nm^3/hr$. After liquefaction, portion 22 has a temperature of about 107.4° K., and a pressure of about 10.98 $kg/cm^2$.

Waste stream 30 as removed from the bottom of rectification column 24 has a flow rate of approximately 2188.0 $Nm^3/hr$. and a temperature and pressure of approximately that of the column, namely 109.9° K., and 11.01 $kg/cm^2$. Side waste stream 30*a* is divided from waste stream 30 and flows at about 67 $Nm^3/hr$. Waste stream 30 enters condenser 32 at a temperature of about 100.8° K. and a pressure of about 6.00 $kg/cm^2$ and leaves air liquefier 34, as waste stream 36 containing warm vapor, at a temperature of about 106.6° K. and a pressure of about 5.87 $kg/cm^2$. Warm waste stream 36 is divided into two portions, portion 38 having a flow rate of approximately 880.0 $Nm^3/hr$. and portion 40 having a flow rate of approximately 1308.0 $Nm^3/hr$. After passage through compressor 42, the resultant compressed waste stream 44 enters main heat exchanger 18 at a temperature of about 143.0° K. and a pressure of approximately 11.09 $kg/cm^2$ and thereafter, is introduced back into rectification column 24 at a pressure of approximately 11.01 $kg/cm^2$ and a temperature of approximately 112.7° K.

Stream 52, representing the vapor fraction removed from stream 46 of tower overhead, has a temperature of about 104.6° K., a pressure of about 10.70 $kg/cm^2$, and a flow rate of approximately 27.0 $Nm^3/hr$. When combined with portion 40 of warmed waste stream 36 and stream 86 (having a flow rate of about 23.0 $Nm^3/hr$, a temperature of about 102.8° K., and a pressure of about 9.52 $kg/cm^2$ combined stream 54 has a flow rate of approximately 1358.0 $Nm^3/hr$, a temperature of about 106.2° K., and a pressure of about 5.87 $kg/cm^2$. After combined stream 54 passes through main heat exchanger 18, it has a temperature of about 142.0° K. and a pressure of about 5.78 $kg/cm^2$. After expansion, side waste stream 30*a* is added to expanded waste stream 58 having a temperature of about 105.8° K. and a pressure of about 1.61 $kg/cm^2$. Expanded waste stream 58 leaves air liquefier 34 with a temperature of about 106.6° K. and and a pressure of about 1.55 $kg/cm^2$ and then main heat exchanger 18 with a temperature of 274.0° K. and a pressure of about 1.3 $kg/cm^2$.

Product stream 62 is extracted from rectification column 24 at a flow rate of about 1138.0 $Nm^3/hr$, a temperature of about 104.6° K., and a pressure of about 10.72 $kg/cm^2$. Stripper overhead stream 78 flowing at about 97.0 $Nm^3/hr$ and having a temperature of about 102.8° K. and a pressure of about 9.53 $kg/cm^2$ is partially condensed against fully vaporized waste stream 30*a*. Side waste stream 30*a* enters stripper recondenser 82 at a temperature of about 98.7° K. and a pressure of about 5.11 $kg/cm^2$. The gas phase is separated from the liquid phase in phase separator 84 and stream 86, comprising the liquid phase, is combined with product stream 62 and introduced into stripper column 68 to increase the recovery rate of the further purified product. The combined stream introduced into stripper column 68 has a flow rate of about 1212 $Nm^3/hr$, a temperature of about 102.8° K., and a pressure of about 9.53 $kg/cm^2$.

Further purified product stream 66 is extracted from the bottom of stripper column 68 at a flow rate of about 1180.0 $Nm^3/hr$, a temperature of about 103.0° K., and a pressure of about 9.67 $kg/cm^2$. Further purified product stream 66 leaves air liquefier 34 at a temperature of about 106.6° K., and a pressure of about 9.67 $kg/cm^2$. Partial stream 72 of further purified product stream 66 having a flow rate of about 65.0 $Nm^3/hr$ is introduced into stripper column 68 as the stripper gas. Partial stream 74 of further purified product stream 66 is warmed in main heat exchanger 18 for delivery of the product to the customer at a temperature of about 274.0° K. and a pressure of about 9.55 $kg/cm^2$.

EXAMPLE 5

In this example an ultra-high purity nitrogen product is recovered by the process and apparatus illustrated in FIG. 5. The product recovered contains approximately 0.5 ppb oxygen, 1.0 ppb neon and about 0.003 ppb helium. The process consumes air flowing at about 2513.0 $Nm^3/hr$ and the product flows at a rate of about 1115.0 $Nm^3/hr$. Therefore, the process and apparatus of this example are capable of functioning at a greater efficiency than that of Example 4. The reason for this increase in efficiency relates to the fact that a greater degree of compression and expansion are taking place in this example over other examples presented herein.

Air stream 16 enters main heat exchanger 18 with a temperature of 278.7° K. and a pressure of 11.17 $kg/cm^2$. Within main heat exchanger 18, the Pressure and temperature of air stream 16 drops to about 11.00 $kg/cm^2$ and about 109.9° K., respectively. After division of air stream 16, portion 20 has a flow rate of approximately 2415.0 $Nm^3/hr$ and portion 22 has a flow rate of about 98.0 $Nm^3/hr$. After liquefaction, portion 22 has a temperature of about 107.4° K., and a pressure of about 10.98 $kg/cm^2$.

Waste stream 30 removed from the bottom of rectification column 24 has a flow rate of approximately 2246.0 $Nm^3/hr$. and a temperature and pressure of approximately that of the column, namely 109.9° K., and 11.0 $kg/cm^2$, respectively. Side waste stream 30*a* is divided from waste stream 30 and flows at about 366.0 $Nm^3/hr$. Stream 90 containing liquid from partially vaporized waste stream 30*a* is re-added to waste stream 30 to produce waste stream 30*b*. After such addition, waste stream 30*b* vaporizes in condenser 32 at a temperature of about 100.9° K. and a pressure of about 6.00 $kg/cm^2$ and warms in the air liquefier 34. The resultant warm waste stream 36*a* has a temperature of about 106.6° K. and a pressure of about 5.87 $kg/cm^2$. Stream 36*a* is combined with stream 92, containing the vapor portion of stream 30*a*, to produce warm waste stream 36 having a flow rate of about 2246.0 $Nm^3/hr$. Warm waste stream 36 is divided into two portions, portion 38 having a flow rate of approximately 897.0 $Nm^3/hr$. and portion 40 having a flow rate of approximately 1349.0 $Nm^3/hr$ After passage through compressor 42, the resultant compressed waste stream 44 enters main heat exchanger 18 at a temperature of about 143.0° K. and a pressure of approximately 11.09 $kg/cm^2$. Thereafter, compressed waste stream 44 is cooled in main heat exchanger 18 and introduced into rectification column 24 at a pressure of approximately 11.00 kg/cm$^2$ and a temperature of approximately 112.7° K.

Stream 52, representing the vapor fraction removed from stream 46 of tower overhead, has a temperature of about 104.5° K., a pressure of about 10.7 kg/cm$^2$, and a flow rate of approximately 27.0 Nm$^3$/hr After passing through back pressure control valve 89 it is combined with portion 40 of warmed waste stream 36 and stream 87 representing the vapor phase of partially condensed stripper tower overhead (having a flow rate of about 22.0 Nm$^3$/hr, a temperature of about 102.8° K., and a pressure of about 9.53 kg/cm$^2$). The resultant combined stream 54 has a flow rate of approximately 1398.0 Nm$^3$/hr, a temperature of about 106.0° K., and a pressure of about 5.87 kg/cm$^2$. After passage through main heat exchanger 18, combined stream 54 has a temperature of about 141.5° K. and a pressure of about 5.78 kg/cm$^2$. After expansion, the resultant expanded waste has a temperature of 105.3° K. and a pressure of about 1.63 kg/cm$^2$. Expanded waste stream 58 leaves air liquefier 34 with a temperature of about 106.5° K. and and a pressure of about 1.53 kg/cm$^2$ and then main heat exchanger 18 with a temperature of 274.0° K. and a pressure of about 1.30 kg/cm$^2$.

Product stream 62 is extracted from rectification column 24 at a flow rate of about 1138.0 Nm$^3$/hr, a temperature of about 104.6° K., and a pressure of about 10.72 kg/cm$^2$ and sent to the stripper 68. Stripper overhead stream 78 flowing at about 125.0 Nm$^3$/hr and having a temperature of about 102.8° K. and a pressure of about 9.53 kg/cm$^2$ is partially condensed against partially vaporizing waste stream 30*a*. Side waste stream 30*a* enters stripper recondenser 82 at a temperature of about 100.9° K. and a pressure of about 6.00 kg/cm$^2$. The gas phase is separated from the liquid phase in phase separator 84 and stream 86, comprising the liquid phase, is combined with product stream 62 and introduced into stripper column 68 to increase the recovery rate of the further purified product. The combined stream introduced into stripper column 68 has a flow rate of about 1240.0 Nm$^3$/hr, a temperature of about 103.0° K., and a pressure of about 9.67 kg/cm$^2$.

Partially vaporized side waste stream 30*a* is then sent into phase separator 88 for separation of the liquid and vapor phases. Stream 90, extracted from the bottom of phase separator 88 and having a flow rate of about 238.0 Nm$^3$/hr, a temperature of about 101.5° K. and a pressure of about 6.00 kg/cm$^2$, is added to waste stream 30. Stream 92, extracted from the top of phase separator 88 and having a flow rate of about 128.0 Nm$^3$/hr, a temperature of about 101.2° K., and a pressure of about 5.87 kg/cm$^2$ is added to stream 31 after its passage through air liquefier 34 to form warm waste stream 36. The result of such additions is that the refrigeration potential of the partially vaporized side waste stream 30*b* is being recovered and more material is being added to the amount of waste to be compressed. The foregoing operation is to be compared with that of Example 4 in which the fully condensed side waste stream 30*a* is at too low a pressure for there to be any meaningful amount of refrigeration to be recovered.

Further purified product stream 66 is extracted from the bottom of stripper column 68 at a flow rate of about 1207.0 Nm$^3$/hr, a temperature of about 103.0° K., and a pressure of about 9.67 kg/cm$^2$. Further purified product stream 70 leaves air liquefier 34 at a temperature of about 106.6° K., and a pressure of about 9.67 kg/cm$^2$. Partial stream 72 of further purified product stream 66, having a flow rate of about 92.0 Nm$^3$/hr., is introduced into stripper column 68 as stripper gas. Partial stream 74 of further purified product stream 66 is warmed in main heat exchanger 18 for delivery to the customer at a temperature of about 274.0° K. and a pressure of about 9.55 kg/cm$^2$.

While preferred embodiments of the present invention have been shown and described, it will be appreciated by those skilled in the art that numerous changes and additions may be made without departing from the spirit and scope of the invention.

I claim:

1. A process of producing ultra-high purity nitrogen comprising:

rectifying air within a rectification column by a low temperature rectification process to produce a tower overhead containing a high purity nitrogen vapor rich in light elements;

partially condensing a stream of the tower overhead so that the stream contains a liquid phase lean in the light elements and a gaseous phase rich in the light elements;

separating the gaseous phase from the stream of the tower overhead;

returning the stream of the tower overhead, after separation of the gaseous phase therefrom, to the rectification column as reflux and stripping the light elements from the reflux within the rectification column to produce the ultra-high purity nitrogen as liquid; and extracting a product stream from the rectification column composed of ultra-high purity nitrogen liquid.

2. The process of claim 1, further comprising further purifying the product stream to produce a further purified product stream by stripping further light elements from the product stream by a stripper gas.

3. The process of claim 2, wherein:

the further light elements are stripped from the product stream by introducing the product stream into the top of a stripper column and the stripper gas into the stripper column below the product stream to produce further purified ultra-high purity nitrogen as liquid at the bottom of the stripper column and a stripper tower overhead; and the further purified product stream is produced by extracting the further purified ultra-high purity nitrogen liquid from the bottom of the stripper column.

4. The process of claim 3, further comprising:

extracting a stripper tower overhead stream from the top of the stripper column; and recompressing the stripper tower overhead stream to rectification column pressure and introducing it into the rectification column to enhance the recovery rate of the further purified product stream.

5. The process of claim 3, further comprising:

extracting a stripper tower overhead stream from the stripper column;

partially condensing the stripper tower overhead stream to produce liquid and gaseous phases within the stripper tower overhead stream, lean and rich in the light elements, respectively;

separating the gaseous phase from the stripper tower overhead stream; and introducing the stripper tower overhead stream to the stripper column after separation of the gaseous phase therefrom for stripping therewithin by the stripper gas in order to increase the production rate of the product stream.

6. The process of claim 3, wherein the rectification column also Produces a process liquid; and wherein the method further comprises:

extracting a stripper tower overhead stream from the stripper column;

extracting a process liquid stream composed of the process liquid from the rectification column;

partially condensing the stripper tower overhead stream against partially vaporizing the liquid process stream to produce liquid and gaseous phases within the stripper tower overhead stream, lean and rich in the light elements, respectively;

separating the gaseous phase from the stripper tower overhead stream;

introducing the stripper tower overhead stream to the stripper column after separation of the gaseous phase therefrom for stripping therewithin by the stripper gas in order to increase production of the further purified product stream;

recovering refrigeration potential from the partially vaporized liquid product stream; and introducing the recovered refrigeration potential back into the low temperature rectification process to increase production of the product stream and therefore further increase production of the further purified product stream.

7. The process of claim 1, wherein the low temperature rectification process includes:

producing a column bottom within the rectification column comprising oxygen rich liquid;

extracting a waste stream from the rectification column composed of the column bottom; and a waste recompression cycle including:

dividing the waste stream into two partial waste streams, compressing one of the two partial waste streams, cooling the one compressed partial waste stream, and introducing the one compressed partial waste stream into the rectification column to enhance production of the liquid ultra-high purity nitrogen produced within the rectification column and hence, the product stream;

combining the other of the two partial waste streams with a light element rich stream composed of the gaseous phase separated from the stream of tower overhead to form a combined waste stream;

partially heating the combined waste stream and then engine expanding the partially heated combined waste stream with the performance of work to create refrigeration for the low temperature rectification process;

recovering a portion of the work of expansion in the compression of the partially heated combined waste stream; and dissipating a remaining portion of the work of expansion from the low temperature rectification process.

8. The process of claim 7, wherein:

after extraction from the rectification column, the product stream is further purified by introducing it into the top of a stripper column and a stripper gas into the stripper column below the product stream to produce the further purified ultra-high purity nitrogen as liquid at the bottom of the stripper column and a stripper tower overhead;

the further purified product stream is produced by extracting the further purified ultra-high purity nitrogen liquid from the bottom of the stripper column; and the combined waste stream is formed by also combining the stripper tower overhead with the other of the two partial waste streams and the light element rich stream.

9. The process of claim 7, wherein:

after extraction from the rectification column, the product stream is further purified by introducing the liquid stream into the top of a stripper column and a stripper gas into the stripper column below the product stream to produce the further purified ultra-high purity nitrogen as liquid at the bottom of the stripper column and a stripper tower overhead; and the product stream is produced by extracting the further purified ultra-high purity nitrogen liquid from the bottom of the stripper column; and further comprising:

extracting a stripper tower overhead stream from the top of the stripper column; and recompressing the stripper tower overhead to rectification column pressure and introducing it into the rectification column to enhance the recovery rate of the further purified product stream.

10. The process of claim 7, further comprising:

further purifying the product stream to produce a further purified product stream by introducing the product stream into the top of a stripper column and a stripper gas into the stripper column below the product stream to produce the further purified ultra-high purity nitrogen as liquid at the bottom of the stripper column and a stripper tower overhead;

forming the further purified product stream by extracting the further purified ultra-high purity nitrogen liquid from the bottom of the stripper column;

extracting a side waste stream from the waste stream;

extracting a stripper tower overhead stream from the stripper column;

partially condensing the stripper tower overhead stream against fully vaporizing the side waste stream to produce liquid and gaseous phases within the stripper tower overhead stream, lean and rich in the light elements, respectively;

separating the gaseous phase from the stripper tower overhead stream;

introducing the stripper tower overhead liquid to the stripper column for stripping therewithin by the stripper gas in order to increase production of the product stream.

11. The process of claim 7, further comprising:

further purifying the product stream to produce a further purified product stream by introducing the Product stream into the top of a stripper column and a stripper gas into the stripper column below the product stream to produce the further purified ultra-high purity nitrogen as liquid at the bottom of the stripper column and a stripper tower overhead;

forming the further purified product stream by extracting the further purified ultra-high purity nitrogen liquid from the bottom of the stripper column;

extracting a side waste stream from the waste stream;

extracting a stripper tower overhead stream from the stripper column;

partially condensing the stripper tower overhead stream against partially vaporizing the side waste stream to produce liquid and gaseous phases within the stripper tower overhead stream, lean and rich in the light elements, respectively;

separating the gaseous phase from the stripper tower overhead stream;

introducing the stripper tower overhead to the stripper column for stripping therewithin by the stripper gas in order to increase production of the product stream;

recovering the refrigeration potential from the partially condensed liquid product stream; and introducing the recovered refrigeration potential back into the low temperature rectification process to increase production of the product stream and therefore to further increase production of the further purified product stream

12. The process of claim 7, wherein the rectification process also includes:

cooling the air, after compression and purification thereof, to a temperature suitable for its rectification within the rectification column:

dividing the air into two cooled partial air streams;

introducing one of the two cooled partial air streams into the rectification column;

liquefying the other of the two cooled partial air streams and thereafter, introducing it into the rectification column;

prior to the division of the waste stream, passing the waste stream along with the product stream in a heat transfer relationship to the stream of tower overhead to partially condense the stream of tower overhead;

after the partial condensation of the stream of the tower overhead, passing the waste stream, the liquid stream and the engine expanded combined waste stream in a heat transfer relationship to the other cooled partial air stream in order to liquefy the other cooled partial air stream; and after the liquefaction of the other cooled partial air stream, passing the turboexpanded combined waste stream together with the product stream and the combined stream, before being partially heated, in a heat transfer relationship to the incoming air and the one compressed partial waste stream in order to cool the air to the temperature suitable for rectification while cooling the one compressed partial waste stream and vaporizing the product stream.

13. The process of claim 11, wherein:

the product stream is further purified to produce a further purified product stream by introducing the product stream into the top of a stripper column and a stripper gas into the stripper column below the product stream to produce a further purified ultra-high purity nitrogen liquid at the bottom of the stripper column and a stripper tower overhead;

the further purified product stream is produced by extracting the further purified ultra-high purity nitrogen liquid from the bottom of the stripper column;

the combined waste stream is formed by also combining the stripper tower overhead with the other of the two partial waste streams and the light element rich stream; and the stripper gas is created by extracting a partial product stream from the product stream after its passage in a heat transfer relationship to the other to the other cooled partial air stream.

14. The process of claim 11, wherein:

the product stream is further purified to produce a further purified product stream by introducing the product stream into the top of a stripper column and a stripper gas into the stripper column below the product stream to produce the further purified ultra-high purity nitrogen as liquid at the bottom of the stripper column and a stripper tower overhead;

the product stream is produced by extracting the further purified ultra-high purity nitrogen liquid from the bottom of the stripper column; and the stripper gas is created by extracting a partial product stream from the further purified product stream after its passage in a heat transfer relationship to the other to the other cooled partial air stream; and further comprising:

extracting a stripper tower overhead stream from the top of the stripper column; and recompressing the stripper tower overhead stream to rectification column pressure and introducing it into the rectification column to enhance the recovery rate of the further purified product stream.

15. The process of claim 11, further comprising:

further purifying the product stream to product a further purified product stream by introducing the product stream into the top of a stripper column and a stripper gas into the stripper column below the product stream to produce further purified ultra-high purity nitrogen as liquid at the bottom of the stripper column and a stripper tower overhead;

producing the further purified product stream by extracting the further purified ultra-high purity nitrogen liquid from the bottom of the stripper column;

extracting a waste side stream from the waste stream;

extracting a stripper tower overhead stream from the stripper column;

partially condensing the stripper tower overhead stream against fully vaporizing the waste side stream to produce liquid and gaseous phases within the stripper tower overhead stream, lean and rich in the light elements, respectively;

separating the gaseous phase from the partially condensed stripper tower overhead stream;

introducing the partially condensed stripper tower overhead after separation of the gaseous phase therefrom, to the stripper column for stripping therewithin by the stripper gas in order to increase the production rate of the product stream;

forming a stream of the separated gaseous phase and combining it with the light element rich stream and the other of the two partial waste streams to form the combined stream; and before passage of the engine expanded combined waste stream in a heat transfer relationship to the other cooled partial air stream, introducing the fully condensed side waste stream into the engine expanded, partially heated combined waste stream to recover cooling potential of the fully condensed side waste stream; and wherein the stripper gas is created by extracting a partial product stream from the further purified product stream after its passage in a heat transfer relationship to the other cooled partial air stream.

16. The process of claim 11, further comprising:

further purifying the product stream to produce a further purified product stream by introducing the product stream into the top of a stripper column and a stripper gas into the stripper column below the product stream to produce further purified ultra-high purity nitrogen as liquid at the bottom of the stripper column and a stripper tower overhead;

forming the further purified product stream by extracting the further purified ultra-high purity nitrogen liquid from the bottom of the stripper column;

extracting a waste side stream from the waste stream;

extracting a stripper tower overhead stream from the stripper column;

partially condensing the stripper tower overhead stream against partially vaporizing the waste side stream to produce a rich gaseous phase and a lean liquid phase within the stripper tower overhead stream, rich and lean in the light elements, respectively, and vapor and unvaporized phases in the waste side stream;

separating the rich gaseous phase from the partially condensed stripper tower overhead stream;

introducing the partially condensed stripper tower overhead stream, after separation of the rich gaseous phase therefrom, to the stripper column for stripping therewithin by the stripper gas in order to increase the production rate of the product stream;

forming a stream of the separated rich gaseous phase of the stripper tower overhead and combining it with the light element rich stream and the other of the two partial waste streams to form the combined stream;

before passage of the waste stream and the product stream in a heat transfer relationship to the stream of tower overhead, introducing the unvaporized phase of the waste side stream into the waste stream;

after passage of the waste stream in a heat transfer relationship to the other cooled partial air stream, introducing the vapor phase of the waste side stream into the waste stream; and wherein the stripper gas is created by extracting a partial product stream from the product stream after its passage in a heat transfer relationship to the other cooled partial air stream.

17. An apparatus for producing ultra high purity nitrogen comprising:

low temperature rectification means having a rectification column for rectifying air within the rectification column so that nitrogen and light elements concentrate as tower overhead in the form of a high purity nitrogen as vapor rich in the light elements;

condensing means connected to the top of the rectification column for partially condensing a stream of the tower overhead so that the stream contains a gaseous phase rich in the light elements and a liquid phase lean in the light elements;

phase separation means receiving the stream of the tower overhead from the condensing means for separating the gaseous phase from the stream of the tower overhead;

the phase separation means connected to the top of the rectification column so that the stream of the tower overhead, after separation of the gaseous phase therefrom, returns to the top of the rectification column as reflux;

the column sized such that the reflux is stripped of the light element to form the ultra high purity nitrogen as liquid below the top of the column; and delivery means for extracting a product stream composed of ultra-high purity nitrogen liquid from the rectification column and for delivering the ultra-high purity nitrogen from the apparatus.

18. The apparatus of claim 17, wherein the delivery means also has means for further purifying the product stream to form a further purified product stream and for delivering the further purified product stream from the apparatus.

19. The apparatus of claim 17, wherein the further purification means comprises:

means for producing a stripper gas leaner in the light elements than the ultra-high purity nitrogen;

a stripper column connected to the stripper gas production means so that the stripper gas rises in the stripper column;

the stripper column connected to the rectification column so that the product stream falls in the stripper column and is stripped by the stripper gas to produce further purified ultra-high purity nitrogen as liquid, at the bottom of the stripper column; and means for extracting the further purified ultra-high purity nitrogen liquid from the bottom of the stripper column and for forming the further purified product stream from the extracted ultra-high purity nitrogen liquid.

20. The apparatus of claim 19, further comprising:

a recycle compressor connected between the top of the stripper column and a suitable point of the rectification column for compressing a stripper tower overhead stream composed of stripper tower overhead to column pressure and introducing the compressed stripper tower overhead stream into the column to increase production of ultra-high purity nitrogen.

21. The apparatus of claim 19, further comprising:

means connected to the top of the stripper column for partially condensing a stripper tower overhead stream composed of stripper tower overhead and thereby producing within the stripper tower overhead stream a rich gaseous phase and a lean liquid phase, rich and lean in the light elements, respectively; and separation means for separating the rich gaseous phase from the lean liquid phase;

the separation means connected to the stripper column so that the lean liquid phase falls within the column and is also stripped by the stripper gas to increase the production of the further purified product stream.

* * * * *